US009999913B2

(12) United States Patent
Alaña Gómez et al.

(10) Patent No.: US 9,999,913 B2
(45) Date of Patent: Jun. 19, 2018

(54) ROLLER HEMMING TOOL

(71) Applicant: Ingemat, S.L., Zamudio (ES)

(72) Inventors: Juan José Alaña Gómez, Zamudio (ES); Gaspar Moreno García, Zamudio (ES); Christian Borallo Sánchez, Zamudio (ES); Jesús Bahillo de la Puebla, Zamudio (ES)

(73) Assignee: Ingemat, S.L., Zamudio (Vizcaya) (ES)

( * ) Notice: Subject to any disclaimer, the term of this patent is extended or adjusted under 35 U.S.C. 154(b) by 0 days. days.

(21) Appl. No.: 15/309,329

(22) PCT Filed: Mar. 27, 2015

(86) PCT No.: PCT/ES2015/070233
§ 371 (c)(1),
(2) Date: Nov. 7, 2016

(87) PCT Pub. No.: WO2015/169983
PCT Pub. Date: Nov. 12, 2015

(65) Prior Publication Data

US 2017/0151602 A1 Jun. 1, 2017

(30) Foreign Application Priority Data

May 8, 2014 (ES) ..... 201430675

(51) Int. Cl.
*B21D 39/02* (2006.01)
*B21D 5/16* (2006.01)

(52) U.S. Cl.
CPC ..... *B21D 39/02* (2013.01); *B21D 39/023* (2013.01); *B21D 5/16* (2013.01)

(58) Field of Classification Search
CPC .. B21B 1/30; B21B 1/224; B21D 5/14; B21D 5/16; B21D 39/02; B21D 39/023; B21D 19/04; B21D 19/043
See application file for complete search history.

(56) References Cited

U.S. PATENT DOCUMENTS

2005/0229666 A1 10/2005 Toeniskoetter
2010/0242561 A1* 9/2010 Reith ..... B21D 39/023 72/252.5
2012/0297854 A1 11/2012 Cyrek et al.

FOREIGN PATENT DOCUMENTS

CN 102009096 A 4/2011
DE 10011854 A1 9/2001
(Continued)

OTHER PUBLICATIONS

EPO translation of ES 2232271 A1 from Nov. 2017.*

*Primary Examiner* — R. K. Arundale
*Assistant Examiner* — Pradeep C Battula
(74) *Attorney, Agent, or Firm* — The Webb Law Firm

(57) ABSTRACT

A roller hemming tool having a main hollow body including a first end for fastening to a robot and a second end having a secondary body which, in turn, includes at least one roller. The tool also includes the following elements which are axially distributed therein: a load cell on the first end; a die in contact with the load cell; a first cylinder in contact with the die; a second cylinder to which the secondary body is fastened; an elastic means in contact with the first cylinder and the second cylinder; and a cap limiting the axial movement of the second cylinder. When in use, the roller continuously exerts pressure in an axial direction, said pressure being successively transmitted to the secondary body, the second cylinder, the elastic means, the first cylinder, the die and up to the load cell.

12 Claims, 3 Drawing Sheets

(56) References Cited

FOREIGN PATENT DOCUMENTS

| | | | |
|---|---|---|---|
| ES | 2232271 | A1 * | 5/2005 |
| ES | 2324960 | T3 | 8/2009 |

* cited by examiner

ROLLER HEMMING TOOL

CROSS-REFERENCE TO RELATED APPLICATIONS

This application is the United States national phase of International Application No. PCT/ES2015/070233 filed Mar. 27, 2015, and claims priority to Spanish Patent Application No. P201430675 filed May 8, 2014, the disclosures of which are hereby incorporated in their entirety by reference.

BACKGROUND OF THE INVENTION

Field of the Invention

The present invention refers to a roller hemming tool whose configuration and design allows for monitoring the stresses during the hemming process and adjusting the pressure exerted by the roller in a quick and simple way.

Description of Related Art

The roller hemming process or operation is currently known in the art, which is used, for example, when joining two panels with two of their surfaces in contact with each other, as interior panel and exterior panel.

This hemming process comprises two stages: a pre-hemming stage and a hemming stage.

The pre-hemming stage comprises the successive folding of a flange of the exterior panel outline, until said flange forms a pre-defined angle with respect to the interior panel. Subsequently, during the hemming stage, the flange concludes its folding onto the interior panel, thus joining both panels.

This hemming process or operation is carried out, during its two stages, by repeatedly rolling certain rolls or rollers through the flanges of the component or panel outlines according to pre-defined paths, such that the flanges of the panel outlines tend to fold through said paths due to a certain pressure exerted by said rollers. The pressure exerted by the rollers during the hemming stage is higher than the pressure applied by the rollers during the pre-hemming stage, this being so because during the hemming stage apart from concluding the folding of the flange, enough pressure needs to be applied onto the flange to guarantee the joining of both panels.

The paths described by the rollers must be described accurately; therefore, the rollers are guided through mechanisms and devices, such as robots, capable of describing the path with a high degree of accuracy.

In addition, more than one roller is typically required to conduct the folding required for each panel. This is due to the availability of several large-size rollers that allow for folding large areas by rolling, with great quality, and there are also several small-size rollers providing foldings in areas which require a reduced bending radius. Additionally, rollers of various shapes are known (cylindrical, conical, etc.) and with different orientations relative to the robot which guides them, facilitating the positioning of the robot, allowing for energy and time to be saved in the movements, apart from contributing to preventing the undesired collision of the rollers or the robot itself with elements arranged close to the hemming area.

The robots are usually programmed by linear interpolations, that is, they follow paths defined by linear segments. This entails that, upon describing curved paths, small misadjustments are irremediably carried out, in the range of the hundredths, between the paths to be followed by the robot and the path actually followed by it. In this way, the roller is no longer in contact with the component or reduces its pressure on the flange at certain points when separating therefrom.

Document CN 102009096 discloses an elastic knurling tool of a robot, which is characterized in that a cover plate flange and a sleeve are fixedly connected by bolts; a pressure sensor is fixedly arranged on the cover plate flange by the bolts, a pressure head of the sensor is connected to the bottom of the pressure sensor by threads, a spring compressing block supports against the pressure head of the sensor by the upper end of a compressed spring, and the lower end of the compressed spring supports against the top end of a spline shaft; a roller wheel installing block for installing a blank-pressed roller wheel is arranged and is connected with the spline shaft by a connecting block, and the mutual rotation between the roller wheel installing block and the spline shaft is limited by a flat key of the spline shaft; and the rotation between the spline shaft and the sleeve is stopped by the flat key of the spline shaft. The elastic knurling tool has the advantage of simple structure, is easy to implement, and can meet the requirements of an elastic adjusting mechanism of a knurling system.

SUMMARY OF THE INVENTION

The present invention, apart from reaching the goals and preventing the inconveniences mentioned in previous sections, allows for knowing the pressure or stresses applied on the components or panels. Knowing this data is interesting and important mainly because it allows knowing the conditions of the working stress of the robot at every moment, apart from knowing the necessary forces to bend different materials of various thicknesses. The fact of knowing the robot's stress at every moment during its operation also allows for obtaining reference information that may be reflected in a chart.

This chart may show, among other data, the position of the robot at every moment during its operation and the force, pressure or stress exerted against the component or panel at all times. With this information, the working conditions of the system may be identified and, in those cases in which the robot does not follow the pre-defined working conditions, due to undesired unexpected events, it allows for having a guideline of the working conditions to which the robot operation needs to be adjusted again.

This monitoring of the working conditions is especially relevant during the tune-up of robots used in the roller hemming operation or process, since there is an interaction between people and machinery. Said tune-up comprises a manual adjustment of the theoretical programming carried out for the movement of the robots, in addition to establishing the pressure values to be applied by said robots by means of rollers in the components to be treated.

To enable data collection during the rolling of the rollers and then conduct the monitoring of said data, the robots may comprise, for example, a spring element to prevent the rollers and components from losing contact with each other during the hemming operation or process. When the roller is supported on the surface of the component to be hemmed exerting pressure, the spring element is compressed and, when the roller rolls moving through the component and the roller tends to separate from said component to be hemmed, the spring element tends to recover its natural elongation, keeping the roller in contact with the component.

Although the spring element is an elastic element of linear work, and therefore the pressure exerted by the rollers against the components in the direction in which the spring element extends longitudinally is proportional to the variation of its elongation with respect to its unloaded status, it is not sufficient to obtain precise data of the pressure exerted with which reference information to be reflected in the mentioned chart is defined.

This is due to the fact that at certain points said pressure may be transmitted at very reduced values of the spring element elongation variation, in the range of millimeters or even tenths of millimeter, it is very hard to visually appreciate said variation in the spring elongation, and therefore, in the value of the exerted pressure. As a consequence of the difficulty in visually appreciating said variations, it is not possible to make valid comparisons between different pressure values.

So as to obtain a clear and effective visualization and assessment of the different stress values exerted by the rollers during their rolling, the hemming tool may additionally comprise precision devices to measure pressures, such as load cells.

Said precision devices collect measures of pressure exerted against them, enabling them to be transmitted, in the form of an electric signal, to an analogue/digital converter which may show in a legible manner, in the form of numerical values, the stresses measured by the above-mentioned precision devices.

The roller hemming tool, which is the object of the present invention, comprises a main hollow body, which comprises a first end for fastening to a robot and a second end comprising a secondary body which, in turn, comprises at least one roller. The secondary body may comprise up to eight rollers.

An important feature of the present invention is that the main body comprises in axial distribution therein a load cell on the first end; a die in contact with the load cell; a first cylinder in contact with the die; a second cylinder to which the secondary body is fastened; an elastic means in contact with the first cylinder and the second cylinder; and a cap limiting the axial movement of the second cylinder towards the outer part of the main body.

In this manner, when the roller is in use, it continuously exerts pressure in axial direction, said pressure being successively transmitted to the secondary body, the second cylinder, the elastic means, the first cylinder, the die and, finally, the load cell.

Another important feature of the present invention is that the cap can be screwed in the second end such that the compression of the elastic means with the roller at rest or in operation is adjustable by threading the cap in the second end. It is considered that the present tool or the roller are at rest when the roller does not exert pressure against the component to be hemmed and, on the other hand, it is considered that the present tool or roller are in operation when the roller does apply pressure against the component to be hemmed.

In addition, the roller hemming tool, which is the object of the present invention, may comprise clamp screws exerting pressure against an exterior cylindrical surface of the second end after being screwed in some threaded-through holes distributed angularly in the exterior perimeter of the cap.

Alternatively, the present roller hemming tool may comprise a first key attachable to the main body by screwing a first screw in an elongated orifice comprised in the first key, being the first key partially and tightly placeable in a hole of a castellated edge comprised by the cap.

Another important feature of the present invention is that the present tool comprises blind holes for the screwing and unscrewing of the cap in the second end through mechanical means.

Another important feature of the present invention is that it may comprise certain anti-rotation means which prevent the relative rotation of the second cylinder with respect to its central longitudinal axis while allowing for the axial movement of the second cylinder.

Figure 1:
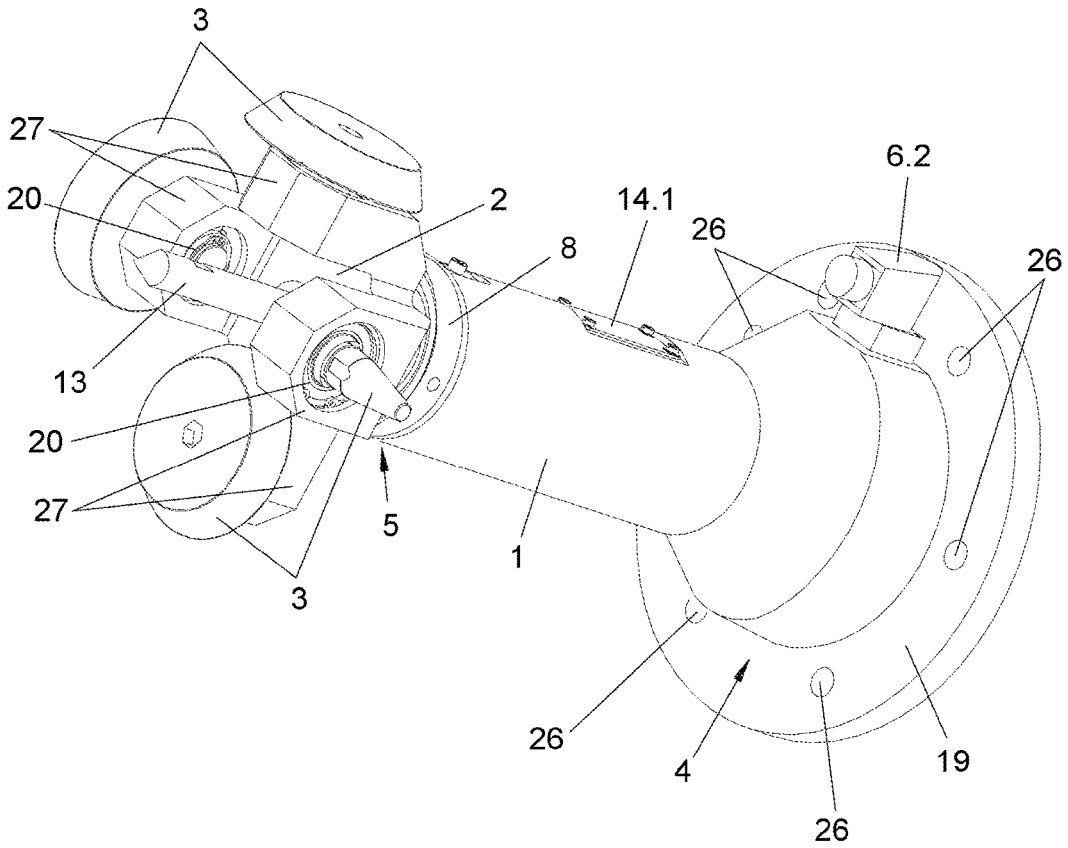
FIG. 1 shows a perspective view of a roller hemming tool, which is the object of the present invention, according to a FIRST embodiment.

Below is a list of the different components represented in the figures and comprised in the invention:

1. Main body
2. Secondary body
3. Roller
4. First end
5. Second end
6. Load cell
6.1. Die
6.2. Connector
7. Elastic means
8. Cap
9.1. First plain bearing
9.2. Second plain bearing
10. Fourth screw
11. First cylinder
12. Second cylinder
12'. Protrusion
13. Reference element
14. Anti-rotation means
14.1. Removable gusset
14.2. Second key
14.3. Second screw
15. Blind orifice
16. Clamp screws
17. First key
17'. Elongated orifice
18. Hole
19. Plate
20. Rolling bearing
21. Threaded-through hole
22. Recess
23. First screw
24. Third screw
25. First orifice
26. Second orifice
27. Fastening

DESCRIPTION OF THE INVENTION

Figure 2:
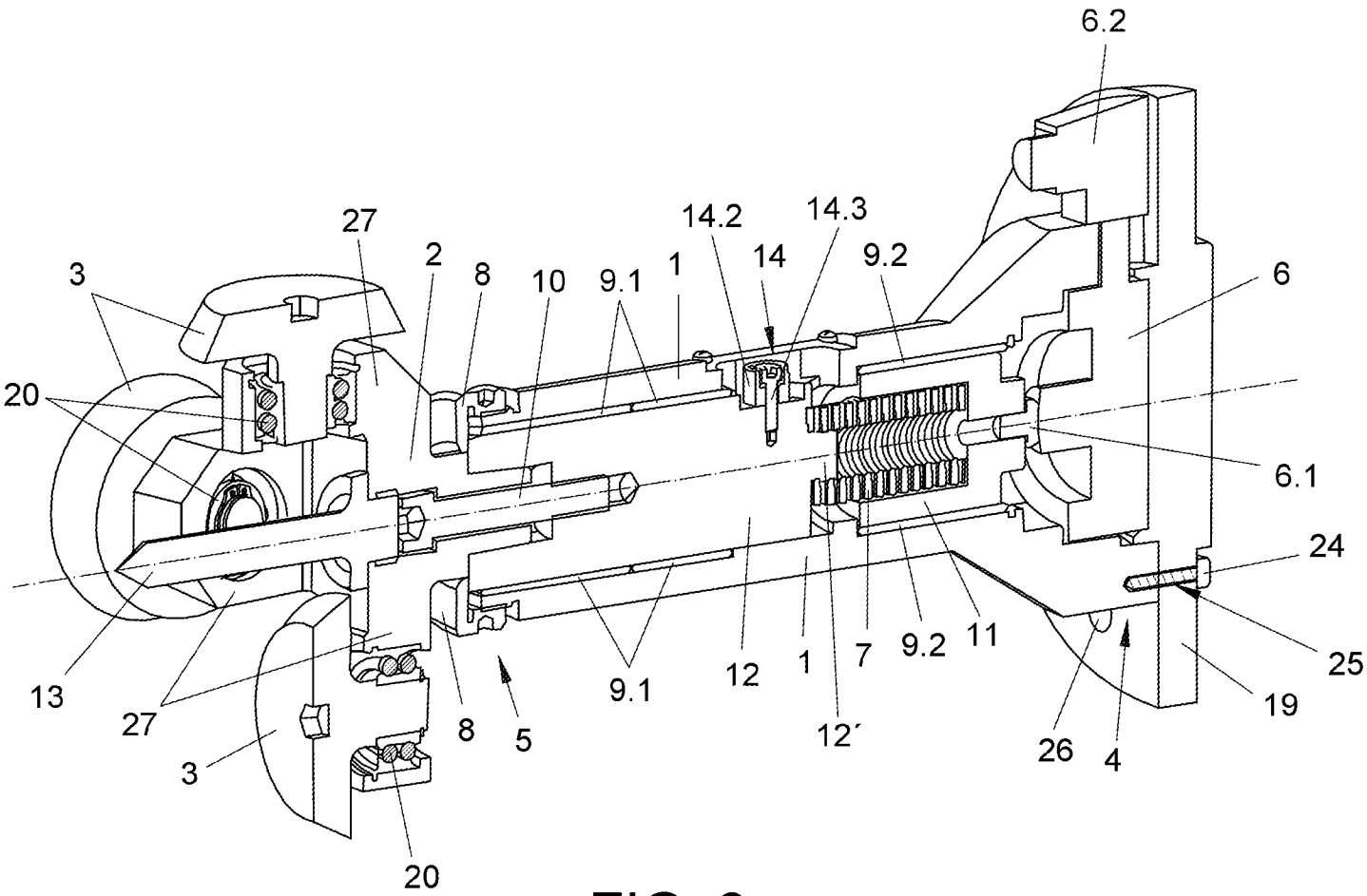
FIG. 2 shows a perspective view of a longitudinal section of the roller hemming tool of FIG. 1.

As indicated, and as it can be appreciated in FIGS. 1 and 2, the present invention describes a roller hemming tool (3) which preferably comprises a main body (1) of hollow cylindrical longitudinal structure, which comprises a first end (4) to which a robot is fastened.

The first end (4) comprises a plate (19) as a limit to connect the present tool to a robotised arm by means of second orifices (26), while the plate (19) comprises first orifices (25) angularly distributed for their fastening to the end of the main body (1) by screwing third screws (24), as it may be appreciated in FIG. 2. This configuration provides access to the inside of the main body (1) through the first end (4). In another preferred embodiment, not represented in the figures, this plate (19) is used as closure of the first end (4) of the main body (1), which is also fastened to a coupling cylinder, which is in turn fastened to the robotised arm. With this preferred embodiment, an extension in the final position of the rollers (3) is obtained.

A second end (5) of the main body (1) comprises a secondary body (2) partially inserted therein. The secondary body (2) is fastened in an axial and rotating manner with respect to a second cylinder (12), as described further on. The secondary body (2) comprises four fastenings (27) distributed angularly every 90° to arrange a roller (3) in each of the fastenings (27). The fastenings (27) may vary in length and orientation depending on the folding operations to be carried out in each piece. In other preferred embodiments, the number of fastenings (27) varies from 1 to 8, thus changing the number of rollers (3) comprised by the present roller (3) hemming tool. Each of the fastenings (27) additionally comprises a rolling bearing (20) for the rotation of each of the rollers (3) in their rolling through the flanges of the component or panel outlines, conducting progressive foldings of said flanges through pre-defined paths.

Additionally, the secondary body (2) comprises a reference element (13) of the robot fastened to the central part, a Tool Control Point (TCP) protruding in a centred and axial manner from the rest of the tool. The reference element (13) comprises a metallic rod preferably fastened by being screwed in the secondary body (2). In other preferred embodiments, the reference element (13) may be fastened to another area of the roller hemming tool.

For the axial and rotational fastening of the secondary body (2) to the second cylinder (12) arranged in the inside of the main body (1) in its second end (5), the present tool comprises a fourth screw (10). In addition, the secondary body (2) is partially inserted in the second cylinder (12) favouring its axially centred arrangement.

The second cylinder (12) is wrapped by first plain bearings (9.1) to ensure and favour their guiding during their axial movement inside the main body (1). Additionally, the second cylinder (12) is prevented from rotating with respect to its own central longitudinal axis due to anti-rotation means (14) arranged, in the preferred embodiment shown in the figures, in a section near the inner end of the second cylinder (12), that is, in the end of the second cylinder (12) which is closest to the first end (4). The main body (1) comprises an access opening to said anti-rotation means (14) which is covered with a removable gusset (14.1).

The anti-rotation means (14) preferably comprise a second key (14.2) fastened to the exterior of the second cylinder (12) by means of a second screw (14.3). The second key (14.2) is provided with a hole in the main body (1) of longitudinal extension, according to the longitudinal extension of the main body (1), for it to be housed and moved, since the second cylinder (12) moves axially without rotation.

In the embodiment shown in FIG. 2, the interior end of the second cylinder (12) comprises in a round surface a perfectly centred protrusion (12'), which serves for tightly placing an end of an elastic means (7), such as an elastic spring or spring element, in said inner end of the second cylinder (12). Preferably, at least half the length of the elastic means (7) is inserted through the centre of a round surface of a first cylinder (11) facing the round surface of the inner end of the second cylinder (12) in the inside of the main body (1). In a preferred embodiment shown in FIG. 2, the length of the elastic means (7) inserted is of approximately three fourths of the total length.

By having the elastic means (7) partially inserted in the first cylinder (11) and wrapping through pressure the protrusion (12') of the second cylinder (12), it allows for obtaining a fastening and an axial guiding of the longitudinal extension of the elastic means (7) without allowing said elastic means (7) to be laterally deformed, especially by being compressed.

Preferably, the first cylinder (11) is wrapped by second plain bearings (9.2) to ensure and favour their guiding when moving axially in the inside of the main body (1). Additionally, the first cylinder (11) comprises an external end that is the end closest to the exterior of the main body (1) following an axial path, with a round surface, the central part of which supplements a die (6.1). In this manner, any pressure arising from the axial movement of the first cylinder (11), especially towards the plate (19), is withstood by the die (6.1).

The die (6.1) transmits the pressure exerted by said movements of the first cylinder (11) to a conventional load cell (6), the load cell (6) being withheld by the plate (19) in the first end (4) against the main body (1). Placing the die (6.1) prevents the wear of the first cylinder (11) and/or the load cell (6), the replacement of the die (6.1) being cheaper than the replacement of the first cylinder (11) and/or the load cell (6).

The load cell (6) is inserted in the main body (1) except for at least one connector (6.2) for the connection of the load cell (6) to a conventional analogue/digital converter, not shown in the figures. The analogue/digital converter transforms into numerical values the stresses or pressures measured by the above-mentioned load cell (6) through the die (6.1), and in turn, it works as a wireless transmitter to transmit the measured values. The numerical values obtained are sent to a monitoring device, PC or specific display unit for them to be viewed and assessed.

The assembly formed by the die (6.1), the first cylinder (11), the elastic means (7), the second cylinder (12) and the secondary body (2), perfectly and axially aligned with each other by their centres, is axially located and defined by a cap (8) arranged in the second end (5) of the main body (1). It is important that said assembly is arranged in an aligned manner, preferably with their central longitudinal axis, for a linear and effective transmission of the stresses or pressure exerted by the present tool against the components to be treated in the longitudinal direction of said tool.

The secondary body (2) is inserted through the cap (8). The cap (8) is screwed in the second end (5) and is in contact with the second cylinder (12) such that it prevents its movement to the exterior of the main body (1) through the second end (5).

Figure 3:
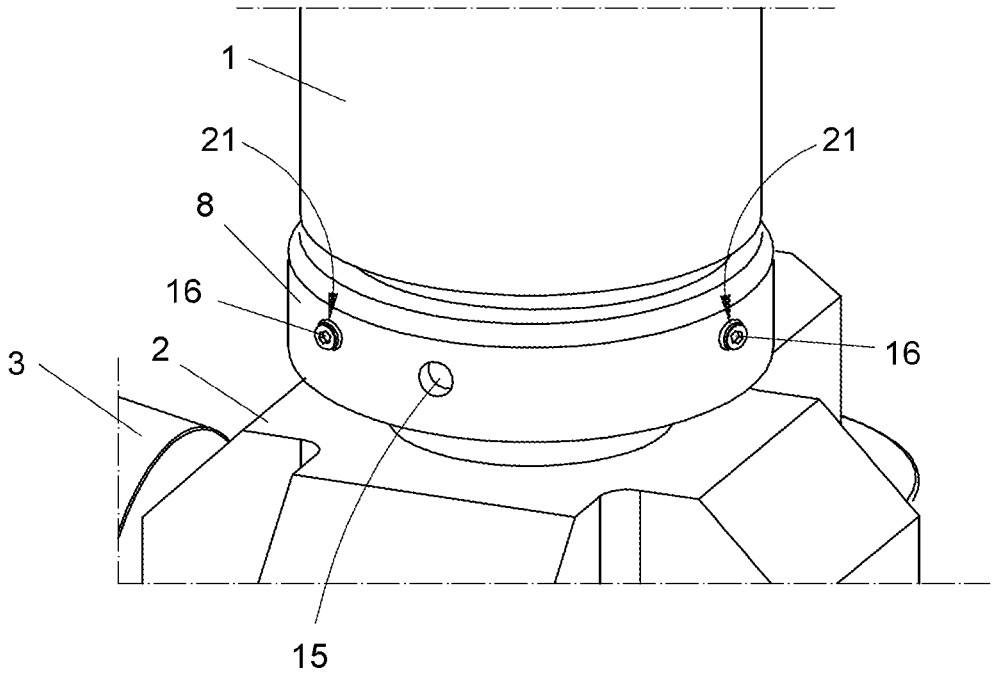
FIG. 3 shows a view of a cap according to a first embodiment.
Figure 4:
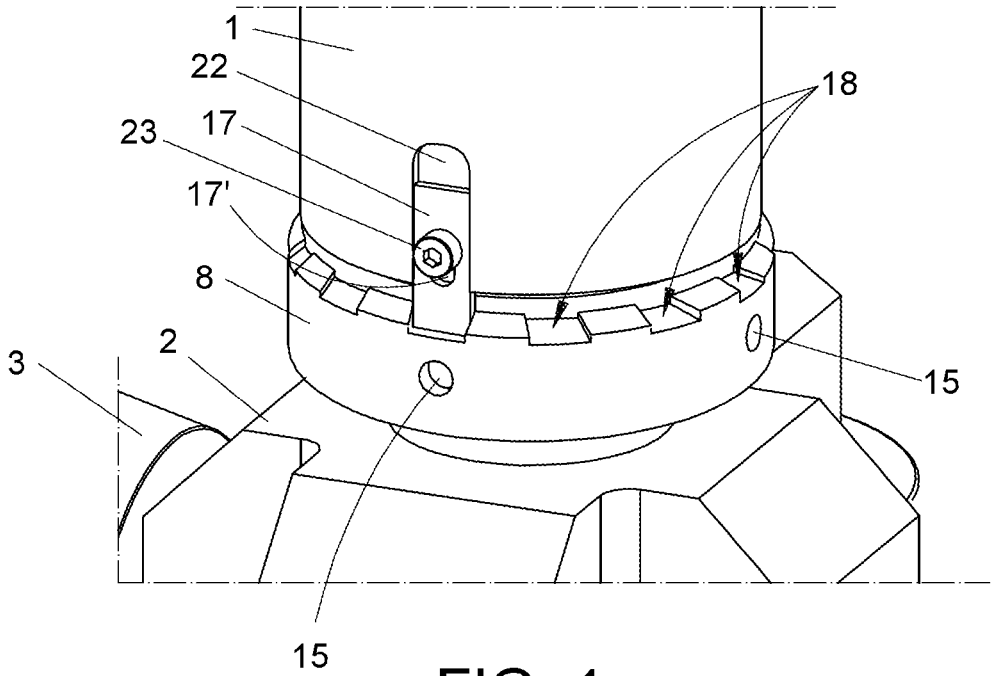
FIG. 4 shows a view of a cap according to a second embodiment.

The present hemming tool comprises blind orifices (15), more clearly appreciated in FIGS. 3 and 4, performed in the outer cylindrical perimeter of the cap (8), angularly distributed, to partially insert mechanical means to facilitate the rotation of the cap (8). Preferably, these mechanical means are hook spanners or a similar mechanical element of longitudinal extension which comprises an end placeable in said blind orifices (15).

To ensure or fasten the position of the cap (8) once it is desirably screwed in the second end (5), the cap (8) is fastened in said position by screwing some clamp screws (16), preferably headless screws, in threaded-through orifices (21) arranged in the exterior cylindrical perimeter of the cap (8). The clamp screws (16) are screwed in said threaded-through orifices (21) until the required pressure is exerted against the exterior main body (1) to ensure that the cap (8) will not suffer undesired movements while the present tool is in operation or at rest. This preferred embodiment allows the cap (8) to be fastened in a desired position or the cap (8) to be released from said desired position, without the need to be handled by any other element.

FIG. 4 shows a preferred embodiment as an alternative to the one shown in FIG. 3. In this preferred embodiment, the tool which is the object of the present invention comprises a castellated edge in the cap (8) and a first key (17) with an elongated orifice (17') to insert a first screw (23) that is screwed in the exterior cylindrical surface of the main body (1) for fastening said first key (17) to the exterior surface of the main body (1). The first key (17) is fastened, preferably, in a recess (22). Preferably, in the exterior surface of the main body (1) there are 1 to 8 recesses (22) angularly distributed to ensure lateral immobilisation, preventing the first key (17) from rotating or displacing.

The elongated orifice (17), extending longitudinally based on the longitudinal extension of the main body (1), facilitates the adjustment of the longitudinal position of the first key (17) to the different degrees of cap (8) screwing in the second end (5). Once the cap (8) is screwed up to its desired position in the second end (5), a hole (18) of the castellated edge of the cap (8) closest to the first key (17) is made to coincide with the first key (17), thus leaving the first key (17) tightly introduced in the hole (18) and in the desired longitudinal position by means of the elongated orifice (17').

During the pre-hemming stage, the behaviour of the tool must be similar to that of a rigid body, as in this stage of the hemming operation in which the flange of the outline of an exterior panel is folded towards a pre-defined angle with respect to an interior panel, the precision in the folding of the curved panel areas is not a restrictive parameter, the speed of the operation being more relevant. Therefore, given that the roller hemming tool of the present invention comprises an elastic means (7), it is necessary to establish a pre-load of said elastic means (7), through which the behaviour of the tool is equivalent to that of a rigid body. This pre-load results from the compression of the elastic means (7) such that the pressure exerted by the robot on the flange during the pre-hemming stage is smaller than the pre-load carried out on the elastic means (7). In this manner, as the pre-load to which the elastic means (7) is subject is not exceeded by the pressure exerted by the robot on the flange during the pre-hemming stage, the behaviour of the elastic means (7) and, therefore, that of the roller hemming tool of the present invention is equivalent to that of a rigid body.

For the embodiment of this pre-load, the cap (8) is screwed until it exerts pressure against the second cylinder (12) which, in turn, compresses the elastic means (7) according to certain desired values. When the cap (8) is screwed until the elastic means (7) reaches the desired compression, said position of the cap (8) is fixed inside its screwing path, as previously explained. In this manner, the rotation of the cap (8) is prevented, thus avoiding undesired variations of the pre-load to which the elastic means (7) is subject.

During the hemming stage, it is necessary to obtain a high degree of precision in the paths and, therefore, correct the deviations existing during the folding of the curved areas of the panels; therefore, during this stage an elastic behaviour of the tool is necessary.

In the hemming stage, a load or pressure is exerted by the hemming tool against the component to be hemmed, resulting in a compression of the elastic means (7). Said compression of the elastic means (7) prevents the rollers (3) from losing contact with the components or the pressure on the components from being reduced as a result of following paths defined by linear segments.

This is so because when the rollers (3) lose contact with the flange of the outline of the panel or component being hemmed, the elastic means (7) pushes the second cylinder (12) and the latter, in turn, pushes the secondary body (2), thus keeping the roller (3) in contact with the flange of the outline of the panel or component being hemmed, correcting the deviation existing between the linear path of the robot and the curvature of the panel or component.

The tool which is the object of the present invention, apart from monitoring the stresses during the hemming process, makes it possible to adapt the status of the elastic means (7) to the requirements of the pre-hemming stage in a quick and simple way, and also facilitates the adjustment or change of the elastic means (7) status, if necessary, when going from the pre-hemming stage to the hemming stage, reducing the time required for that.

Once the nature of the invention is described, it is stated for the relevant purposes that it is not limited to the exact details of this description, but on the contrary, whichever amendments are deemed appropriate may be introduced, insofar as the essential features thereon are not altered. In consequence, the scope of the invention is defined by the following claims.

The invention claimed is:

1. A roller hemming tool, comprising:

a main body comprising a hollow structure having a first end for fastening to a robot and a second end which comprises a secondary body which, in turn, comprises at least one roller;

wherein the main body comprises, axially distributed inside:

a load cell in the first end;

a die in contact with the load cell;

a first cylinder in contact with the die;

a second cylinder to which the secondary body is fastened;

an elastic element in contact with the first cylinder and the second cylinder; and a cap limiting the axial movement of the second cylinder towards an external part of the main body;

wherein:

in use, the roller continuously exerts a pressure in an axial direction, said pressure being successively transmitted to the secondary body, to the second cylinder, to the elastic element, to the first cylinder, to the die and, finally, to the load cell, and the cap is screwed into the second end such that the compression of the elastic element, with the roller at rest or in use, is adjustable by screwing the cap into the second end.

2. The roller hemming tool, according to claim 1, further comprising clamp screws exerting pressure against an exterior cylindrical surface of the second end after being screwed into threaded-through orifices angularly distributed in an exterior perimeter of the cap.

3. The roller hemming tool, claim 2, further comprising blind orifices for the screwing and unscrewing of the cap into the second end through mechanical means.

4. The roller hemming tool, according to claim 3, further comprising anti-rotation means which prevent the relative rotation of the second cylinder with respect to a central longitudinal axis while allowing for axial movement of the second cylinder.

5. The roller hemming tool, according to claim 2, further comprising anti-rotation means which prevent the relative rotation of the second cylinder with respect to a central longitudinal axis while allowing for axial movement of the second cylinder.

6. The roller hemming tool, according to claim 1, further comprising a first key attachable to the main body by screwing a first screw into an elongated orifice in the first key, the first key being partially and tightly placeable in a hole of a castellated edge in the cap.

7. The roller hemming tool, claim 6, further comprising blind orifices for the screwing and unscrewing of the cap into the second end through mechanical means.

8. The roller hemming tool, according to claim 7, further comprising anti-rotation means which prevent the relative rotation of the second cylinder with respect to a central longitudinal axis while allowing for axial movement of the second cylinder.

9. The roller hemming tool, according to claim 6, further comprising anti-rotation means which prevent the relative rotation of the second cylinder with respect to a central longitudinal axis while allowing for axial movement of the second cylinder.

10. The roller hemming tool, claim 1, further comprising blind orifices for the screwing and unscrewing of the cap into the second end through mechanical means.

11. The roller hemming tool, according to claim 10, further comprising anti-rotation means which prevent the relative rotation of the second cylinder with respect to a central longitudinal axis while allowing for axial movement of the second cylinder.

12. The roller hemming tool, according to claim 1, further comprising anti-rotation means which prevent the relative rotation of the second cylinder with respect to a central longitudinal axis while allowing for axial movement of the second cylinder.

* * * * *